US005582443A

United States Patent [19]

Finkelstein et al.

[11] Patent Number: 5,582,443

[45] Date of Patent: Dec. 10, 1996

[54] LOCKING ASSEMBLY FOR REFRIGERATOR DOORS

[76] Inventors: Burl Finkelstein, 1068 Witcher Rd., Newnan, Ga. 30263; Thomas A. Thorsen, 1353 Gordon Rd., Moreland, Ga. 30259

[21] Appl. No.: 411,325

[22] Filed: Mar. 27, 1995

[51] Int. Cl.[6] ..... E05C 3/04

[52] U.S. Cl. ..... 292/202; 292/DIG. 38; 292/DIG. 71

[58] Field of Search ..... 292/DIG. 71, DIG. 59, 292/DIG. 38, 92, 194, 195, 202

[56] References Cited

U.S. PATENT DOCUMENTS 2,469,113 5/1949 Hooker ..... 292/DIG. 71 X 3,412,586 11/1968 Sterner ..... 292/DIG. 71 X

FOREIGN PATENT DOCUMENTS 2005337 4/1979 United Kingdom ..... 292/DIG. 71

*Primary Examiner*—Rodney M. Lindsey
*Attorney, Agent, or Firm*—Robert B. Kennedy

[57] ABSTRACT

A lock for a refrigerator door (11) has a metallic cylinder lock (22) adapted to be mounted to the outside of the door and a metallic latch (13) adapted to be rotatably and releasably mounted adjacent the inside of the door. The metallic cylinder lock is coupled to the metallic latch by a rod (21) and a non-metallic bolt (17) which is adapted to be rotatably mounted at least partially within the door (11). The bolt (17) has a keyway in which the rod (21) is received.

11 Claims, 3 Drawing Sheets

LOCKING ASSEMBLY FOR REFRIGERATOR DOORS

TECHNICAL FIELD

This invention relates to locks for refrigerator and freezer doors.

BACKGROUND OF THE INVENTION

In their simpler form, refrigerator door locks commonly comprise a hasp secured by a pin, bolt or padlock. However, with these locks, a locked refrigerator door can not be unlocked from within, and thus poses a serious hazard. In a more advanced form, refrigerator locks have inside release mechanisms to enable persons inside a locked refrigerator to unlock the door and open it for exit. Such locking assemblies commonly comprise an externally accessible cylinder lock coupled with an inside latch by a rotatable rod such that the inside latch may be rotated between latched and unlatched positions both by a turn of a key from outside of the door and by hand from inside of the door.

With other types of locking assemblies, the latch has been hinged to a housing mounted to the interior side of the refrigerator door and held in place by a ring pin. Again, the latch is rotatable between its latched and unlatched positions by the turn of a key from the outside of the door. For releasing the latch from within the refrigerator, the ring pin is pulled to release the latch. To return the latch to its rotatable position for rotatably latching and unlatching the door, the holes in the housing and the latch are aligned and the ring pin is reinserted.

In another common design, a Z-shaped latch is rotatably mounted to the rotatable rod by a long screw inserted from the interior side of the refrigerator door through a housing to the rod. Again, from outside the door the Z-shaped latch is rotatable between latched and unlatched positions by the turn of a key. From inside the door, the Z-shaped latch is rotatable between latched and unlatched positions by manually unlatching the Z-shaped latch.

Refrigerator door locking systems of the types just described have all had a common problem with respect to thermal conductivity through the refrigerator door due to their metallic composition for strength. In addition, the latch in such locking assemblies often adheres to the door, the jamb or other locking assembly parts when exposed to refrigeration or freezing temperatures. Such adherence, also known as frosting, increases the moment of inertia for the locking assembly and makes ordinary movement of the latch between latched and unlatched positions more difficult. Moreover, the high profile of such locking assemblies along the interior of the door often obstructs movement of carts and catches workers' clothing. The need for the locking assembly to have a low inside profile is particularly apparent where locking assemblies are installed in doors which have a limited range of motion and, in turn, a limited area with which to load and unload a refrigerator.

Accordingly, it is seen that a need remains for a locking assembly for a refrigerator door that inhibits thermal conductivity through the door while retaining structural strength and operational reliability, that resists frosting of the latch either to the door or to other parts of the locking assembly, and that has a low profile. It is to the provision of such therefore that the present invention is primarily directed.

SUMMARY OF THE INVENTION

In a preferred form of the invention, a locking assembly for a refrigerator door comprises a metallic cylinder lock adapted to be mounted to the outside of the door and a metallic latch adapted to be rotatably mounted adjacent the inside of the door. Coupling means are provided for coupling the metallic cylinder lock with the metallic latch. The coupling means includes a rod and a thermal barrier member adapted to be rotatably mounted at least partially within the door and having a keyway in which a portion of the rod is received. With this construction, thermal conductivity through the refrigerator door is inhibited and frosting of the locking assembly is minimized. The profile of the locking assembly is lowered by the metallic latch being shaped and sized to receive a proximal end of the coupling means therewithin.

DETAILED DESCRIPTION

Figure 1:
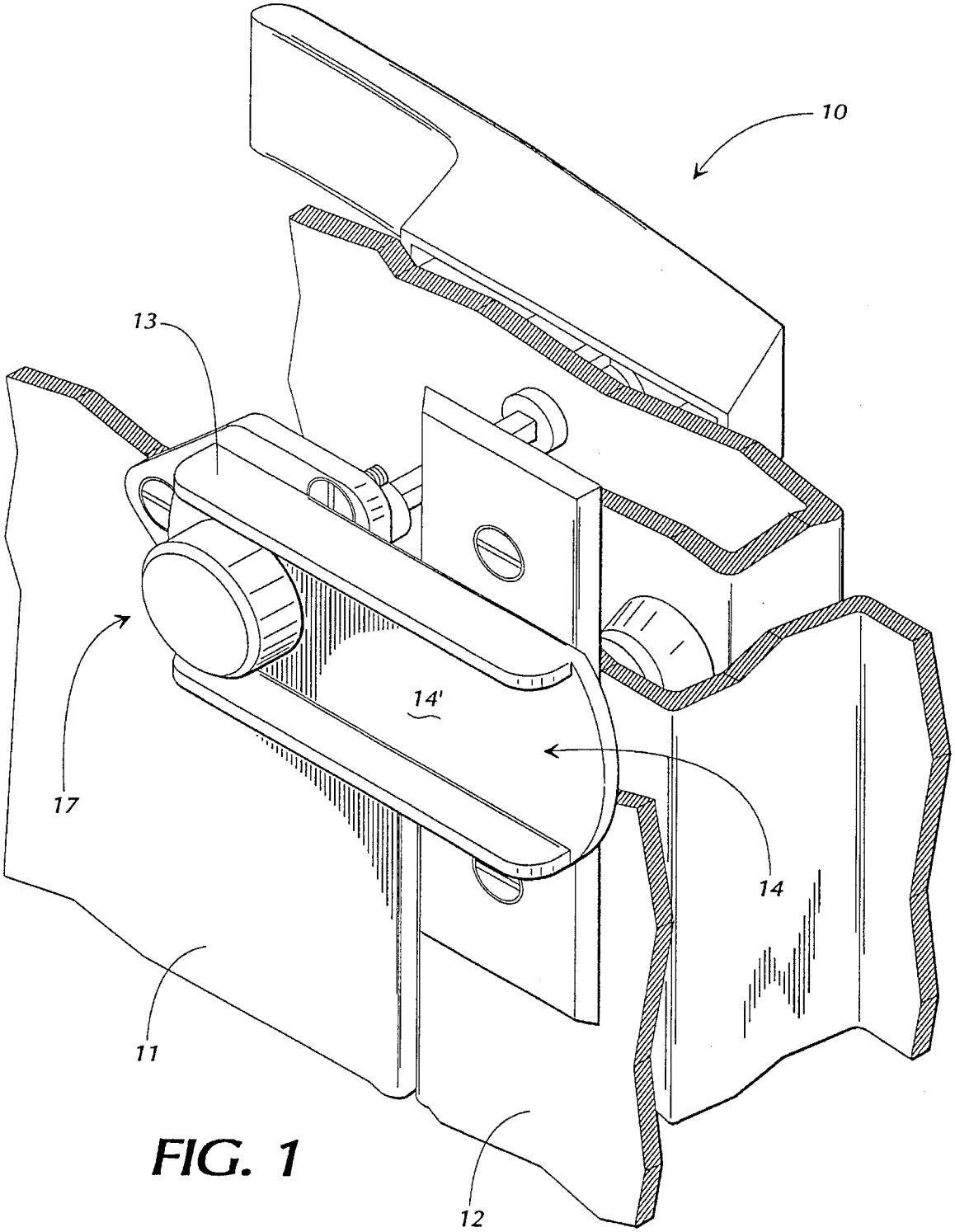
FIG. 1 is a perspective view of a refrigerator door locking assembly that embodies principles of the invention in its preferred form and which is shown in a latched position from within the refrigerator.

With reference to the drawings, there is shown a locking assembly 10 mounted to a refrigerator door 11. The refrigerator door is shown in its closed position against a refrigerator door jamb 12. Both the door 11 and the jamb 12 are conventionally made of a thermally insulative material such as expandable urethane foam encased between aluminum or stainless steel shells or sides. For clarity, the foam core is not shown in the drawings.

Figure 3:
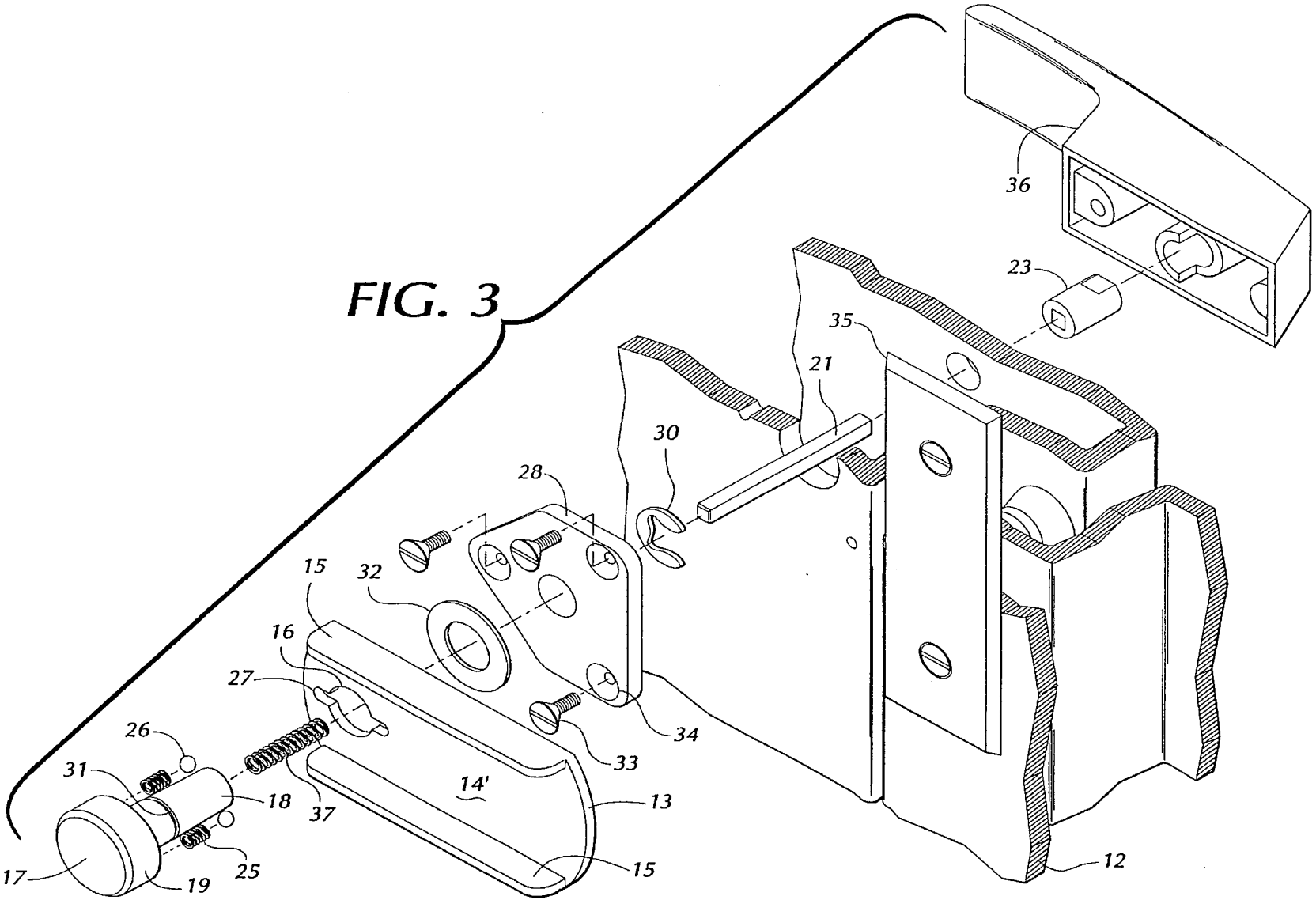
FIG. 3 is an exploded view of the locking assembly.

In FIG. 1, a metallic latch 13 of the locking assembly is shown here on a hinged door in a latched position such that for it to be moved free of the door jamb 12 it must be rotated. The metallic latch has a channel 14 defined by a floor 14' and two sides 15, and a hole 16, that is shown in FIG. 3. The latch 13 is rotatably mounted to a non-metallic bolt 17 which is received through the latch hole 16.

Figure 2:
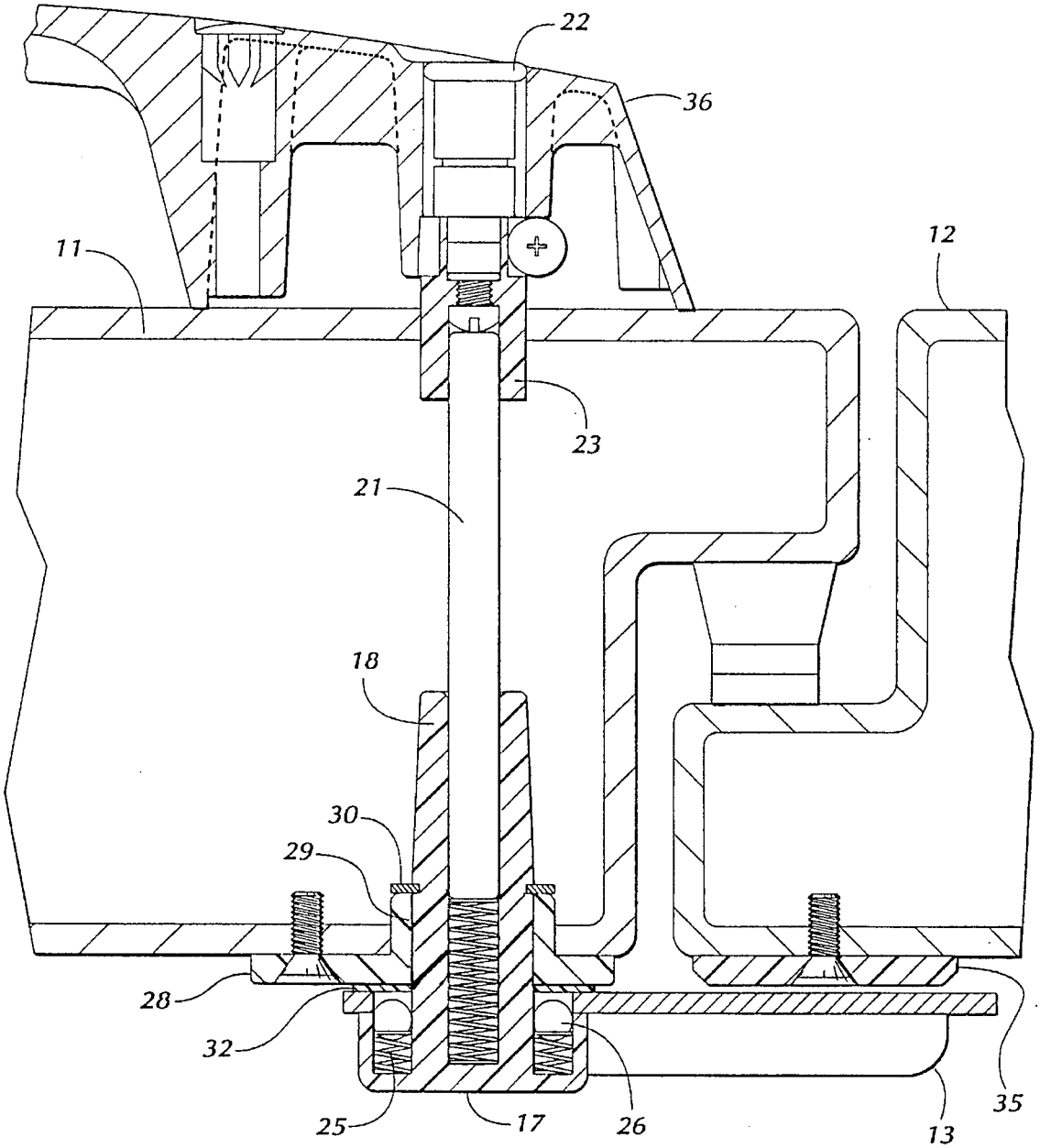
FIG. 2 is a top view, in cross section, of the locking assembly shown in FIG. 1.

As best shown in FIGS. 2 and 3, the non-metallic bolt 17, which is made of a non-metallic material, preferably plastic or nylon, has a shaft 18 and a head 19 formed on one end of the shaft. On the end of the shaft opposite the head, the shaft has a keyway for receiving a rotatable, metallic rod 21. The bolt shaft 18 extends through the hole 16 in the latch channel 14 while its head 19 is substantially received in the channel 14.

The non-metallic bolt also has two annular cavities 24 in which two springs 25 and two steel balls 26 are housed. The hole 16 of the latch 13 has two outcropped pockets 27 in which the steel balls 26 are received.

The non-metallic bolt 17 is rotatably mounted adjacent the inside of the door by a non-metallic mounting sleeve 28. The mounting sleeve 28 has a slightly elongated central opening 29, as shown in FIG. 2, in which the bolt shaft 18 is rotatably received. A retaining ring 30 is positioned in a groove 31 in the shaft and rotatably holds the shaft within the mounting sleeve such that the latch 13 and a washer 32 are also rotatably held between the mounting sleeve 28 and the head 19 of the bolt 17. With the retaining ring in place, the springs are compressed such that the steel balls are pressed toward the latch. When the latch is manually rotated, the steel balls are pushed into and out of the outcropped pockets of the latch hole so that the latch is releasably held to the bolt.

With the retaining ring 30 placed in the groove 31, the bolt 17, the latch 13, and the washer 32 are rotatably mounted to the inside of the door by inserting the rod 21 into the keyway of the bolt and tightening the screws 33 through the holes 34 in the mounting sleeve to the door. The other end of the rod is coupled to the cylinder lock 22, shown in FIG. 2, in a handle 36 by a cylinder coupling member 23 such that the latch 13 is rotatable between latched and unlatched positions from outside the door and can be manually rotated between latched and unlatched positions from the inside of the door.

In the preferred embodiment, a rub plate 35 is placed on the jamb 12 to protect the jamb from any ancillary contact with the latch. Also, in the preferred embodiment, the rod 21 is square shaped in cross section. A square keyway is used for ease in properly inserting the rod into the keyway so that the latch may be aligned to a desired position. However, rods of other shapes and sizes may be used with the locking assembly such as hexagonal rods and threaded rods.

A rod spring 37 is preferably placed in the keyway between the rod and the bolt such that the end of the rod opposite the bolt is pressed into the cylinder coupling member. Where the end of the rod opposite the bolt is threaded, and the cylinder coupling member is threaded, the rod spring may be unnecessary inasmuch as the rod is secured in the cylinder coupling member.

In the preferred embodiment, the bolt, the washer, the rub plate, and the mounting sleeve are made of either plastic or nylon. The cylinder coupling member may be made of a metal as well as a plastic or a nylon. The rod may be made of a metal or fiberglass. The retaining ring is commonly metallic.

It should be understood that the locking assembly may be used in doors other than refrigerator doors such as freezer doors. In addition, the locking assembly may be mounted to doors of differing thicknesses. The locking assembly can also be mounted on-site to a previously installed refrigerator door or prior to installation of the refrigerator door. It should further be understood that the locking assembly can be used in connection with cylinder locks in door handles and in other exterior locks such as deadbolt-type locks. The locking assembly can also be used without the rub plate inasmuch as any contact between the latch and the jamb is commonly minimal, as best shown in FIG. 2.

With the bolt 17 and the mounting sleeve 28 made of a non-metallic material, thermal conductivity through the refrigerator door, previously associated with predominantly metallic locking assemblies, is inhibited in the new locking assembly. In addition, with the bolt, the mounting sleeve, and the rub plate being made of non-metallic material, the latch is unlikely to adhere to abutting metallic parts of the locking assembly, the refrigerator door, or the door jamb. Furthermore, with the bolt head 19 located substantially within the channel 14, the interior latch has a low profile which overcomes problems of access and inconvenience associated with prior art locking assemblies.

It thus is seen that a new locking assembly is now provided that overcomes problems long associated with those of prior art. It should be understood however that many modifications, additions and deletions may be made thereto without departure from the spirit and scope of the invention as set forth in the following claims.

We claim:

1. A locking assembly for a refrigerator door comprising a metallic cylinder lock adapted to be mounted to the outside of the door; a metal latch adapted to be rotatably mounted adjacent the inside of the door; and coupling means for coupling said metallic cylinder lock with said metallic latch which includes a rod and a thermal barrier member adapted to be rotatably mounted at least partially within the door and having a keyway in which a portion of said rod is received, said thermal barrier member has a shaft and a head on one end of said shaft, and said metallic latch has an opening for receiving said shaft.

2. The locking assembly of claim 1 wherein said metallic latch has a channel sized to receive said head of said thermal barrier member.

3. The locking assembly of claim 1 wherein said coupling means further includes a second thermal barrier member having a non-metallic bearing in which said thermal barrier member shaft is rotatably journalled.

4. The locking assembly of claim 3 further comprising a non-metallic washer mounted along said thermal barrier member shaft between said latch and said second thermal barrier member, whereby the non-metallic bearing and the non-metallic washer may deter adhering of the latch against the door or the jamb.

5. The locking assembly of claim 4 wherein said rod is metallic.

6. In a locking assembly for a refrigerator door of the type having an exterior metallic cylinder lock coupled with a manually releasable interior latch by coupling means that includes a rod, the improvement comprising the coupling means having a non-metallic thermal barrier member interposed between said metallic latch and said rod for inhibiting thermal conductivity through the refrigerator door, said thermal barrier member having a shaft and a head on one end of said shaft, and said interior latch having an opening for receiving said shaft.

7. The improvement of claim 6 wherein said non-metallic thermal barrier member is made of a material selected from the group consisting of plastic and nylon.

8. The improvement of claim 6 for a locking assembly having a metallic rod, and wherein said non-metallic thermal barrier member has a keyway in which a portion of said metallic rod is received.

9. The improvement of claim 6 wherein said coupling means further includes a second thermal barrier member having a non-metallic bearing in which said thermal barrier member shaft is rotatably journalled.

10. The improvement of claim 9 further comprising a non-metallic washer mounted along said thermal barrier member shaft between said latch and said second thermal barrier member.

11. The improvement of claim 10 wherein said rod is metallic.

* * * * *